US009909818B2

(12) United States Patent
Goodman et al.

(10) Patent No.: US 9,909,818 B2
(45) Date of Patent: Mar. 6, 2018

(54) HEAT EXCHANGER HAVING A CONDENSATE EXTRACTOR

(71) Applicant: MAHLE International GmbH, Stuttgart (DE)

(72) Inventors: Henry C. Goodman, East Amherst, NY (US); Douglas C. Wintersteen, Burt, NY (US); Yanping Xia, North Tonawanda, NY (US); Joseph B. Czach, Lockport, NY (US); Joel T. Hambruch, Burt, NY (US); Wayne O. Forrest, Gasport, NY (US); Shrikant M. Joshi, Williamsville, NY (US); David E. Samuelson, Wheatfield, NY (US); Donald R. Pautler, Lockport, NY (US); Russell S. Johnson, Tonawanda, NY (US)

(73) Assignee: MAHLE International GmbH, Stuttgart (DE)

( * ) Notice: Subject to any disclaimer, the term of this patent is extended or adjusted under 35 U.S.C. 154(b) by 969 days.

(21) Appl. No.: 13/897,851

(22) Filed: May 20, 2013

(65) Prior Publication Data

US 2013/0306280 A1 Nov. 21, 2013

Related U.S. Application Data

(60) Provisional application No. 61/648,852, filed on May 18, 2012.

(51) Int. Cl.
*F25D 21/14* (2006.01)
*F28F 1/12* (2006.01)
(Continued)

(52) U.S. Cl.
CPC ..... *F28F 1/12* (2013.01); *F28D 1/05366* (2013.01); *F28F 1/128* (2013.01); *F28F 17/005* (2013.01);
(Continued)

(58) Field of Classification Search
CPC ..... F25D 21/14; F25D 2321/142; F25D 2321/143; F25D 2321/146; F24F 2013/227
(Continued)

(56) References Cited

U.S. PATENT DOCUMENTS 2,251,649 A * 8/1941 Wichmann ..... B01D 45/06 62/290
2,553,143 A * 5/1951 McNeely ..... F24F 13/22 62/290
(Continued)

FOREIGN PATENT DOCUMENTS

JP 2010019534 A * 1/2010 ..... F28F 1/30

*Primary Examiner* — Leonard R Leo
(74) *Attorney, Agent, or Firm* — Brinks Gilson & Lione

(57) ABSTRACT

The disclosure presents a heat exchanger assembly having a first manifold, a second manifold spaced from the first manifold, a plurality of refrigerant tubes extending between and in hydraulic communication with the first and second manifolds, a plurality of corrugated fins inserted between the plurality of refrigerant tubes, and a condensate extractor having a comb baffle portion with fingers inserted between the plurality of refrigerant tubes and a conveyance portion. The comb baffle portion is configured to extract condensate from between the plurality of refrigerant tubes and the conveyance portion is configured to convey condensate away from the heat exchanger assembly.

14 Claims, 8 Drawing Sheets

(51) Int. Cl.
*F28F 17/00* (2006.01)
*F28D 1/053* (2006.01)
*F24F 13/22* (2006.01)

(52) U.S. Cl.
CPC ..... *F24F 2013/227* (2013.01); *F25D 21/14* (2013.01); *F25D 2321/146* (2013.01)

(58) Field of Classification Search
USPC ..... 165/110; 62/285, 288–290
See application file for complete search history.

(56) References Cited

U.S. PATENT DOCUMENTS 2,667,041 A * 1/1954 Henderson ..... F25B 39/02 62/290
4,715,433 A * 12/1987 Schwarz ..... F25J 3/04412 165/110
4,950,316 A * 8/1990 Harris ..... F24F 3/1405 62/289
6,000,467 A * 12/1999 Tokizaki ..... F28D 1/05391 165/110
6,932,153 B2 * 8/2005 Ko ..... F28D 1/0535 165/110
7,552,756 B2 * 6/2009 Riniker ..... F28D 1/05366 165/153
8,555,668 B2 * 10/2013 Lee ..... B60H 1/3233 62/288
9,174,511 B2 * 11/2015 Seto ..... B60H 1/00064
2010/0011795 A1 * 1/2010 Stokke ..... A47F 3/04 62/290
2010/0078159 A1 * 4/2010 Kim ..... F25D 21/14 62/285

* cited by examiner

HEAT EXCHANGER HAVING A CONDENSATE EXTRACTOR

CROSS-REFERENCE TO RELATED APPLICATION

This application claims the benefit of U.S. Provisional Patent Application Ser. No. 61/648,852 for an HEAT EXCHANGER HAVING A CONDENSATE EXTRACTOR, filed on May 18, 2012, which is hereby incorporated by reference in its entirety.

TECHNICAL FIELD OF INVENTION

The present invention relates to a heat exchanger having a core defined by a plurality of tubes and fins; more particularly, to a heat exchange having means to collect and remove condensate from the core.

BACKGROUND OF INVENTION

Air-conditioning and heat pump systems for residential and commercial applications are known to employ modified automotive heat exchangers because of their high heat transfer efficiency, durability, and relatively ease of manufacturability. A typical automotive heat exchanger includes an inlet manifold, an outlet manifold, and a plurality of extruded multi-port refrigerant tubes for proving hydraulic communication between the inlet and outlet manifolds. The core of the heat exchanger is defined by the plurality of refrigerant tubes and the corrugated fins disposed between the refrigerant tubes for improved heat transfer efficiency and increased structural rigidity. The refrigerant tubes may be aligned in a parallel and substantially upright orientation with respect to the direction of gravity. The corrugated fins may be provided with louvers to increase heat transfer efficiency.

For heat pump applications, in heating mode the outdoor heat exchanger acts as the evaporator and in cooling mode the indoor heat exchanger acts as the evaporator. When the heat exchanger is in evaporative mode, a partially expanded two-phase refrigerant enters the lower portions of the refrigerant tubes from the inlet manifold and travels up the refrigerant tubes expanding into a vapor phase as the refrigerant absorbs heat from the ambient air. As the airflow passing through the core of the heat exchanger is cooled below its dew point, moisture in the air is condensed onto the exterior surfaces of the refrigerant tubes and fins.

For certain residential and/or commercial applications, the size of the heat exchanger core may reach a height of over 5 feet. Condensate accumulating on the core can build up to form a condensate column within the spaces between the refrigerant tubes and fins; thereby, obstructing airflow through the core resulting in reduced heat transfer efficiency. Aside from the reduction in heat transfer efficiency, the accumulation of condensation in the core of the indoor heat exchanger is especially undesirable when the indoor heat exchanger is operating in evaporative mode. The velocity of the airflow across the heat exchanger face can reach upwards of 700 ft/min. At these high velocities, the airflow impacts the condensate column and launches condensate droplets out of the core into the downstream air plenums.

It is desirable to have an elegant solution to extract and convey condensate away from the heat exchanger core, to minimalize obstruction of airflow through the core and eliminate the launching of condensate droplets into the air plenum.

SUMMARY OF THE INVENTION

The invention provides for a heat exchanger assembly having a first manifold, a second manifold spaced from the first manifold, a plurality of refrigerant tubes extending between and in hydraulic communication with the first and second manifolds, a plurality of corrugated fins inserted between the plurality of refrigerant tubes, and a condensate extractor having a comb baffle portion with extending fingers inserted between the plurality of refrigerant tubes and a conveyance portion. The comb baffle portion is configured to extract condensate from between the plurality of refrigerant tubes and the conveyance portion is configured to convey condensate away from the heat exchanger assembly.

An advantage of the heat exchanger assembly disclosed herein is that it provides a simple elegant solution to extract and convey condensate away from the heat exchanger core. The conveyance of condensate away from the core minimalizes the obstruction of airflow through the core, thereby improving heat transfer efficiency and eliminates condensate launching from the core into the plenum downstream.

BRIEF DESCRIPTION OF DRAWINGS

This invention will be further described with reference to the accompanying drawings in which.

DETAILED DESCRIPTION OF INVENTION

Figure 1:
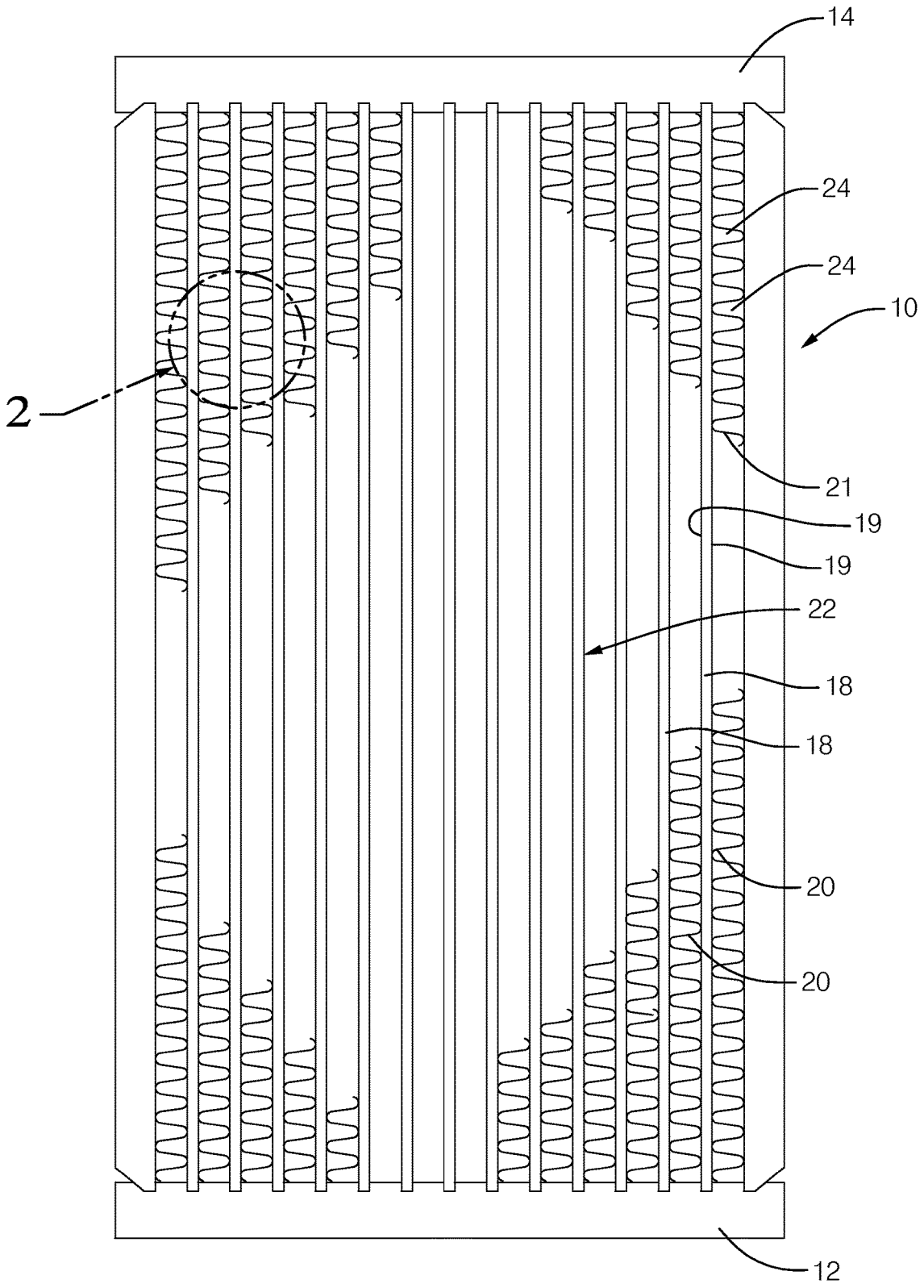
PRIOR ART FIG. 1
FIG. 1 shows a prior art heat exchanger assembly having a core defined by a plurality of refrigerant tubes and fins.
Figure 2:
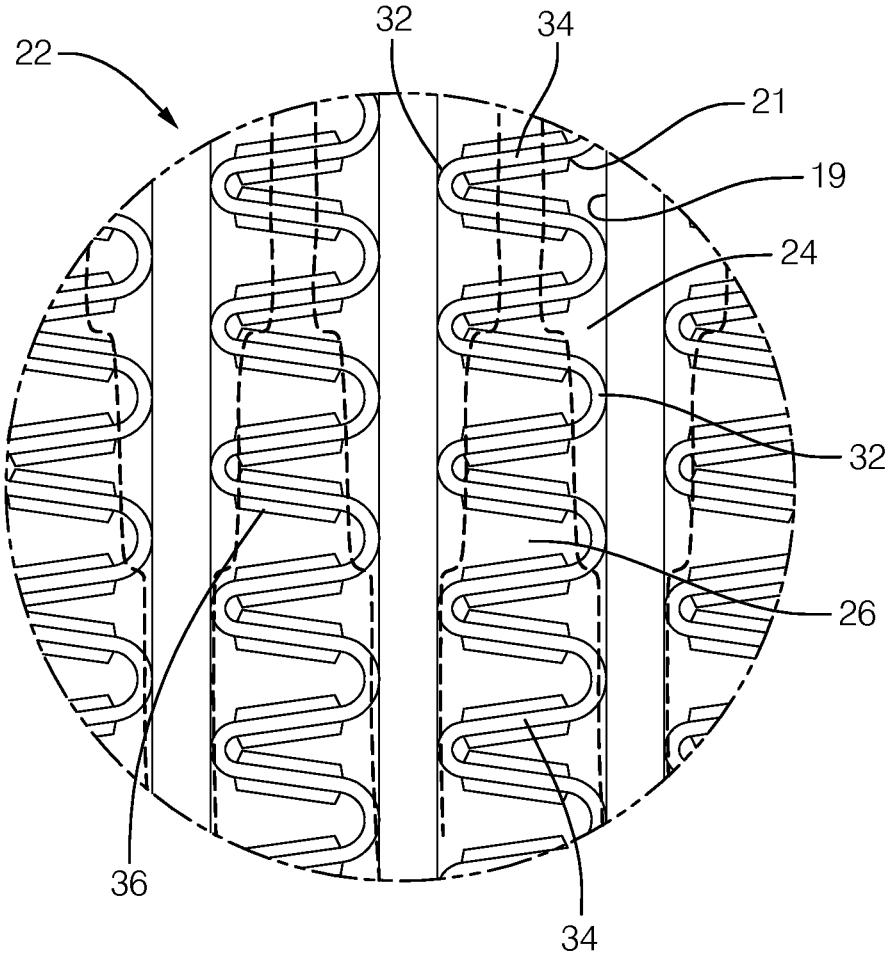
PRIOR ART FIG. 2
FIG. 2 shows detail view of the core of the prior art heat exchanger assembly of FIG. 1 and a column of condensate forming between adjacent refrigerant tubes.

Referring to FIGS. 1 and 2, is a prior art heat exchanger assembly 10 having a lower inlet manifold 12 and an upper outlet manifold 14 extending in a spaced and substantially parallel relationship with the inlet manifold 12. A plurality of substantially parallel refrigerant tubes 18 is provided for hydraulic communication between the inlet and outlet manifolds 12, 14. A plurality of corrugated fins 20 having louvers 36 is inserted between adjacent refrigerant tubes 18 for increased heat transfer efficiency. The refrigerant tubes 18 and corrugated fins 20 define the heat exchanger core 22. The exterior surfaces 19 of the refrigerant tubes 18 cooperates with the exterior surfaces 21 of the corrugated fins 20 to define a plurality of airflow channels 24 for airflow through the core 22.

For residential application of the heat exchanger assembly 10, the manifolds 12, 14 are typically oriented perpendicular to the direction of gravity, while the refrigerant tubes 18 are oriented substantially in or tilted toward the direction of gravity. During operation in evaporative mode, a partially expanded two-phase refrigerant enters the lower portions of the refrigerant tubes 18 from the inlet manifold 12. As the refrigerant rises in the refrigerant tubes 18, it expands into a vapor phase by absorbing heat energy from the airflow that passes through the core 22 of the heat exchanger assembly 10 through the airflow channels 24. As heat energy is transferred from the airflow to the refrigerant, the airflow may be cooled below its dew point. The moisture in the airflow condenses and accumulates onto the exterior surfaces 19 of the refrigerant tubes 18 and exterior surfaces 21 of the fins 20. As the condensation migrates through the louvers 36 of the fins 20 toward the lower portion of the heat exchanger assembly 10, the accumulation of condensate 26 between adjacent refrigerant tubes 18 forms a column of condensate (C); thereby, obstructing the flow of air through the core 22. The obstruction of airflow through the core 22 reduces the heat transfer efficiency of the heat exchanger assembly 10. Furthermore, the high velocity of the airflow across the heat exchanger face can launch condensate droplets out of the core into the downstream air plenums.

Referring to the FIGS. 3 through 9, wherein like numerals indicate corresponding parts throughout the several views, is an exemplary embodiment of a heat exchanger assembly 100 of the current invention. Shown in FIGS. 3 and 4, the heat exchanger assembly 100 includes a first manifold 112 and a second manifold 114 extending in a spaced and substantially parallel relationship with the first manifold 112. A plurality of substantially parallel refrigerant tubes 118 hydraulically connects the first and second manifolds 112, 114. The refrigerant tubes 118 includes a forward nose 128 oriented into the direction of the oncoming airflow and an opposite rear nose 130. A plurality of corrugated fins 120 having alternating ridges 132 connected by legs 134 are inserted between adjacent refrigerant tubes 118, in which the alternating ridges 132 are in contact with the flat exterior surfaces 119 of adjacent refrigerant tubes 118. The legs 134 of the fins 120 may include louvers 136 to increase heat transfer efficiency and to facilitate condensate drainage along the length of the refrigerant tubes 118.

The plurality of refrigerant tubes 118 and corrugated fins 120 between adjacent refrigerant tubes 118 define the heat exchanger core 122. The heat exchanger core 122 includes an upstream face 138 oriented into the direction of airflow and an opposite downstream face 140. The flat exterior surfaces 119 of the refrigerant tubes 118 together with the exterior surfaces 121 of the corrugated fins 120 between adjacent refrigerant tubes 118 define a plurality of airflow channels 124 for airflow through the core 122 from the upstream face 138 to the downstream face 140. The louvers 136 direct airflow through the fins 120 between adjacent airflow channels 124. The refrigerant tubes 118 and fins 120 may be formed from a heat conductive material, such as aluminum. The manifolds 112, 114, refrigerant tubes 118, and fins 120 may be assembled into the heat exchanger assembly 100 and brazed by any known methods in the art to provide a solid liquid tight heat exchanger assembly 100.

Figure 3:
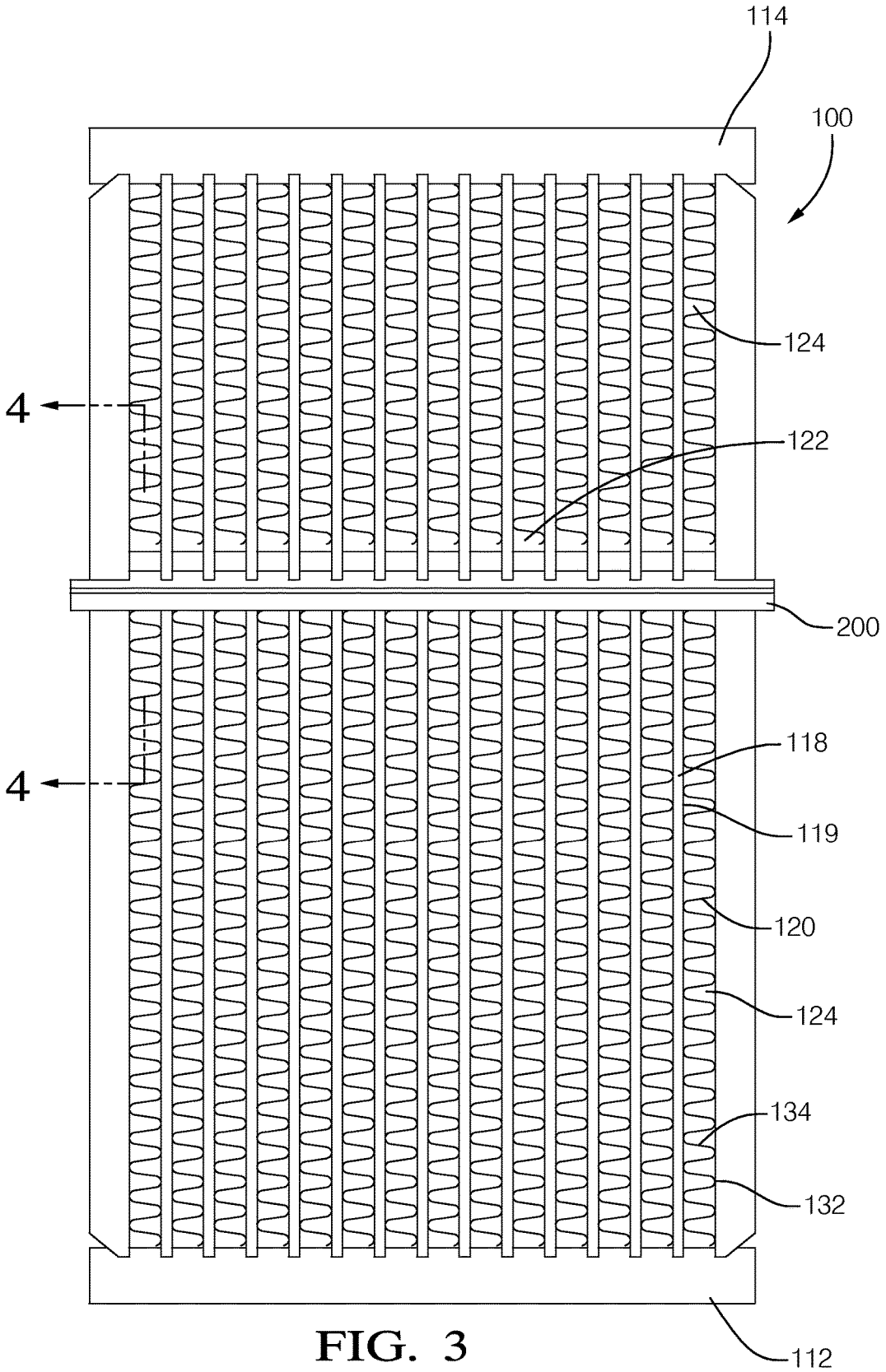
FIG. 3 shows an embodiment of the current invention of a heat exchanger assembly having a condensate extractor.
Figure 4:
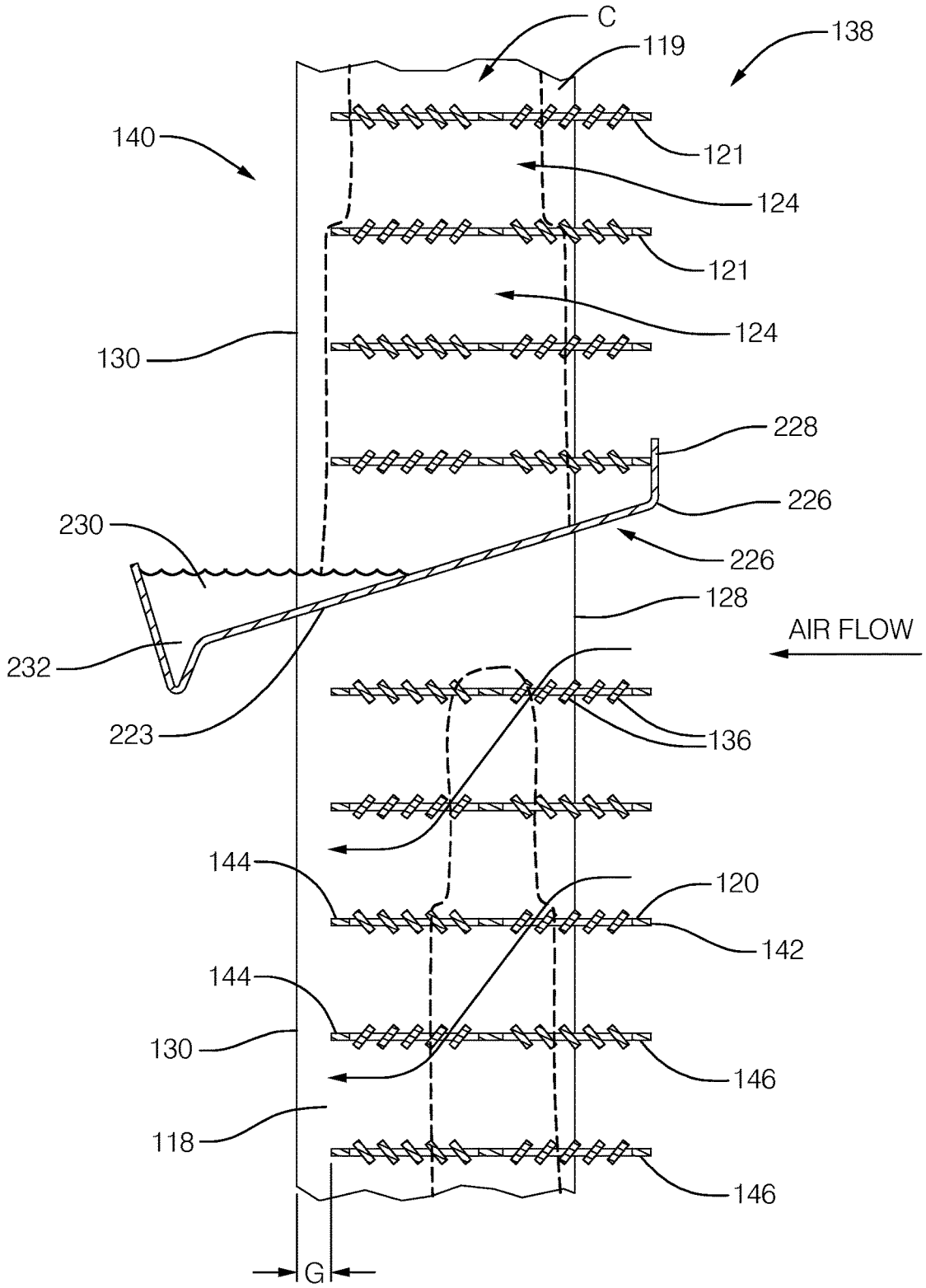
FIG. 4 is a partial side view of the heat exchanger assembly of FIG. 3 across section line 4-4 showing the condensate extractor of FIG. 3.

FIG. 3 shows an embodiment of the current invention of a heat exchanger assembly 100 having a condensate extractor 200 configured to extract and convey condensate away from the core 122. Shown in FIG. 4 is a partial side view of the heat exchanger assembly 100 having a condensate extractor 200 across section line 4-4 of FIG. 3. The corrugated fins 120 include leading edges 142 oriented into the direction of on-coming airflow and an opposite trailing edges 144. The leading edges 142 of the corrugated fins 120 extend pass the forward noses 128 of the refrigerant tubes 118, thereby providing overhangs 146 of corrugated fins 120. The overhangs 146 provide heat transfer surfaces that are drier than the air downstream portion of the fins 120. The trailing edges 144 of the fins 120 extend just short of the rear noses 130 of the refrigerant tubes 118, thereby providing gap surfaces (G) on the flat exterior surfaces 119 of the refrigerant tubes 118 between the trailing edges 144 of the fins 120 and the rear noses 130 of the refrigerant tubes 118.

The moisture in the airflow through the airflow channels 124 condenses into condensate 26 near the upper portion of the core 122 and migrates downward through the louvers 136 of the fins 120 between adjacent refrigerant tubes 122. As the rate of condensation exceeds the rate of drainage, a condensation column (C) may be formed between the refrigerant tubes 122. The stream of oncoming airflow pushes the condensate 26 within the airflow channels 124 toward the rear noses 130 of the refrigerant tubes 118, leaving only a thin film of condensate 26 on the overhangs 146, thus rendering a drier surface that has a higher heat transfer rate. Once the condensate 26 gathers along the gap surface (G), adhesion forces and capillary action of the condensate 26 forms a steady stream of condensate 26 along the gap surfaces (G) of the refrigerant tubes 118 to the bottom of the heat exchanger assembly 100. It was found that the adhesion of this stream of condensate 26 along the exposed gap surfaces (G) of the refrigerant tubes 118 withstand the force of the on-coming stream of airflow, thereby preventing the launching or spitting of the condensate from the core 122 of the heat exchanger assembly 100 into a downstream air plenum.

Figure 5:
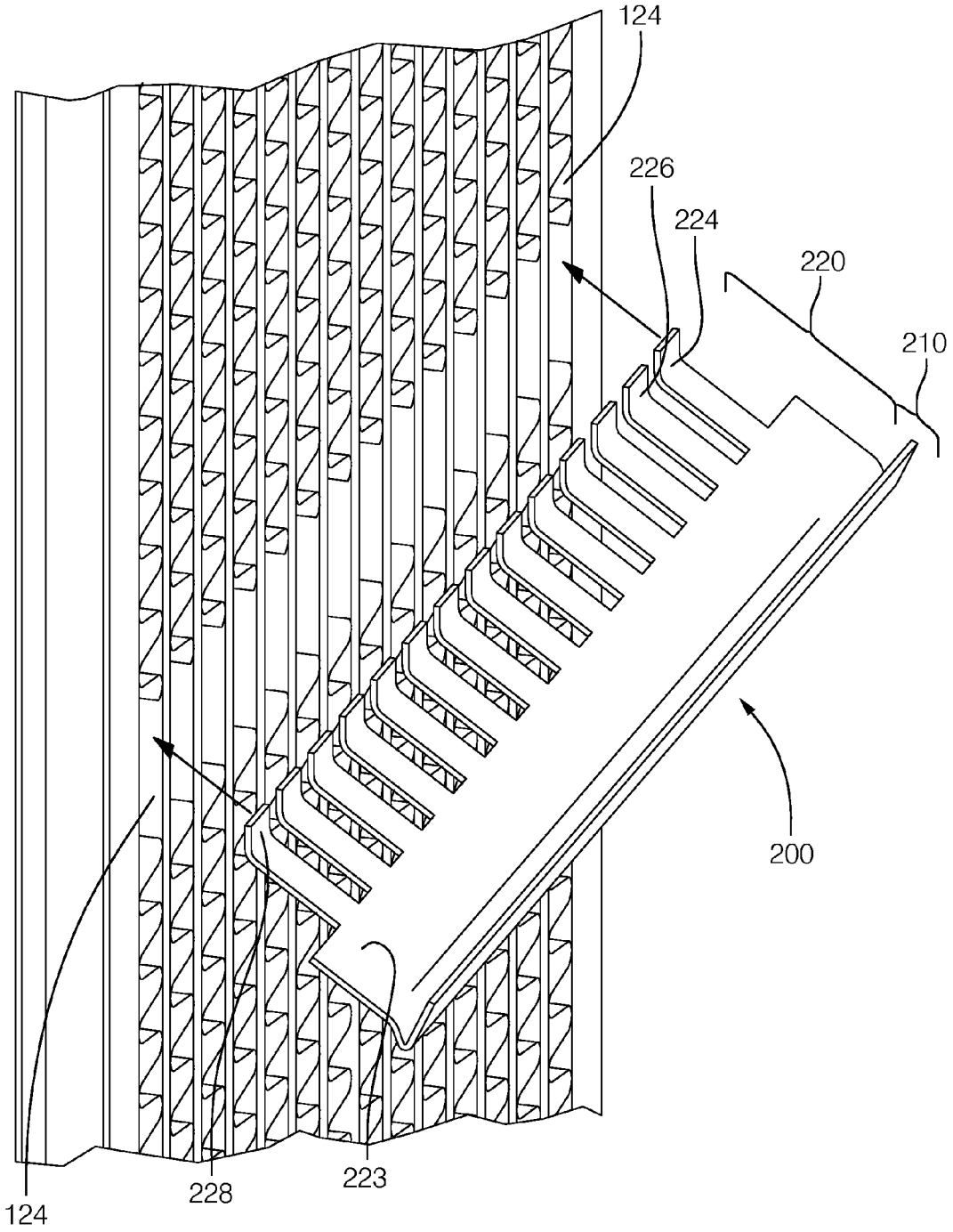
FIG. 5 shows the condensate extractor of FIG. 3 having a condensation collection portion and a comb baffle portion spaced from the heat exchanger assembly.

FIG. 5 shows a condensate extractor 200 spaced apart from the heat exchanger assembly 100. The condensate extractor 200 is configured to work integrally with the leading edge 142 of the fins 120 and gap surfaces (G) to extract and convey condensate 26 away from the core 122 of the heat exchanger assembly 100. The condensate extractor 200 includes a condensate conveyance portion 210 engaged to the downstream face 140 of the core 122 and a comb baffle portion 220 extending through the flow channels 124 of the core 122 engaging the upstream face 138 of the core 122; thereby clipping the condensate extractor 200 into position onto the core 122. The comb baffle portion 220 may include a planar segment 223 and a plurality of fingers 224 extending from the planar segment 223. The fingers 224 are configured to be inserted into and through the flow channels 124. At least one of the fingers 224 includes a distal end 226 having an upturned segment 228 that engages the leading edge 142 of the fin 120.

Referring back to FIG. 4, following the direction of airflow through the core 122, the fingers 224 are sloped in the general direction of gravity backed toward the condensate conveyance portion 210. The fingers 224 extend integrally into the planar segment 223 before transitioning into the conveyance portion 210. The plurality of fingers 224 are in sealing engagement against the flat exterior surfaces 119 and rear noses 130 of the refrigerant tubes 118 to prevent condensate 26 from continuing down the core 122. The comb baffle portion 220 intercepts and guides the condensate 26 away from the flow channels 124 in the core 122 and gap surfaces (G) to the planar segment 223. The conveyance portion 210 may be that of trough 232 positioned at an angle, which functions similar to a drain gutter, and uses gravity to convey the condensate 26 to a spout 256 at an end of the heat exchanger assembly core 122.

The condensate extractor 200 may be formed from a sheet of material amendable to brazing. The sheet metal may be cut into a pattern that may be folded to form the condensate conveyance portion 210 and comb baffle portion 220. The condensate extractor 200 may also be stamped from a sheet of material to define the conveyance portion 210 and comb baffle portion 220. Shown in FIG. 4, the exemplary conveyance portion 210 has a substantially V-shape defined by folding a sheet of sheet metal. Those skilled in the art would recognize that the cross-sectional shape of the conveyance portion 210 may include any cross-sectional shape that can be defined by folding or stamping a sheet of sheet metal, including a U-shape, C-shape, or rectangular shape.

Figure 6:
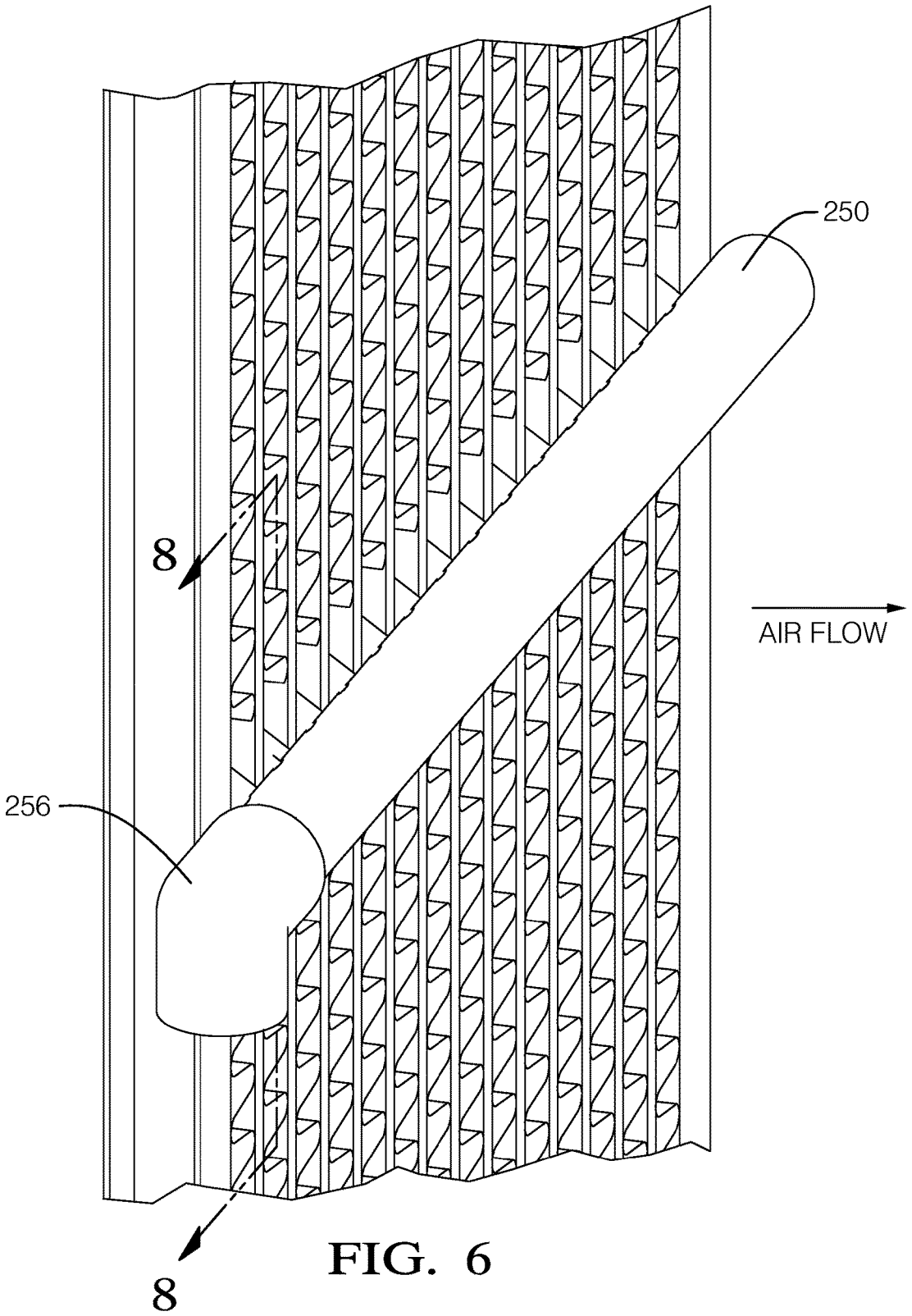
FIG. 6 shows a perspective view of an alternative condensate collection portion of the condensate extractor of FIG. 3.
Figure 7:
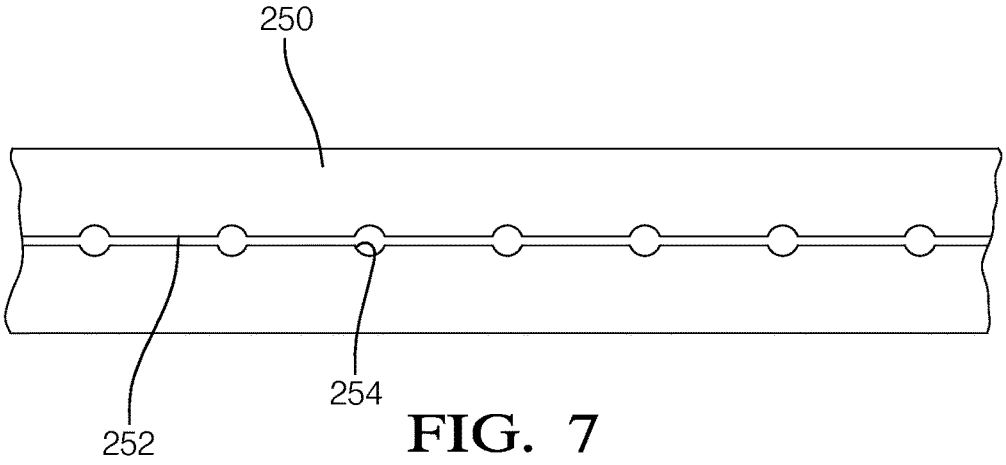
FIG. 7 shows a condensation collection conduit for the condensate extractor shown in FIG. 6.
Figure 8:
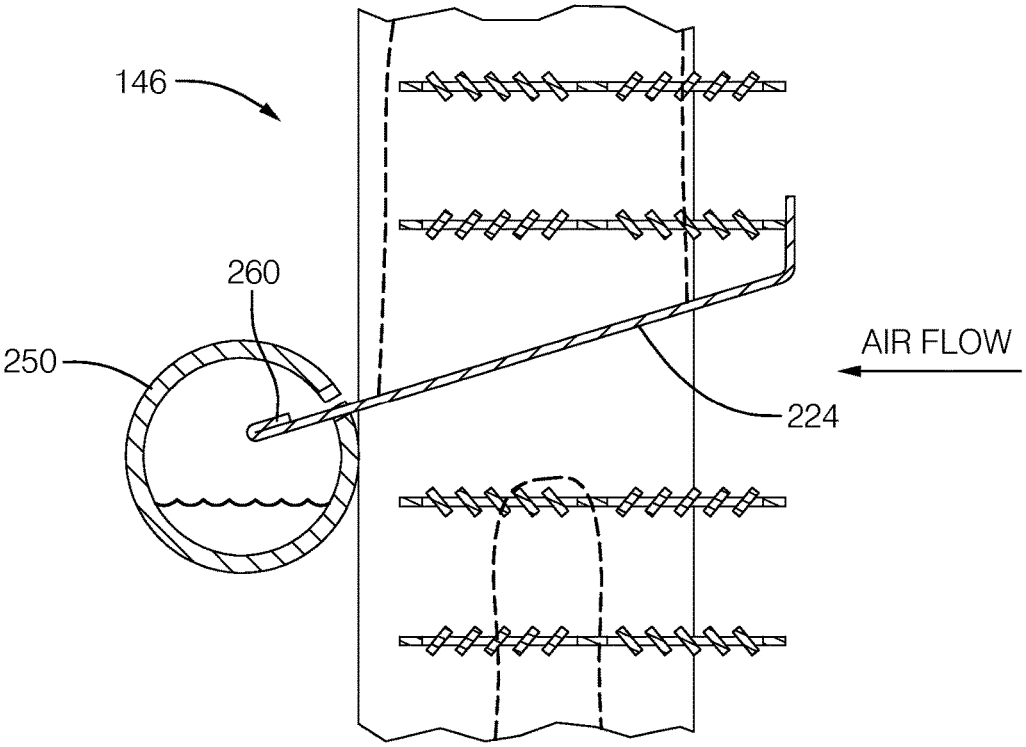
FIG. 8 shows a partial cross section of the condensate extractor shown in FIG. 6 across section line 8-8.

Shown in FIGS. 6 through 8 is a condensate extractor 200 having an alternative conveyance portion 210 defined by a condensate conduit 250. The condensate conduit 250 shown includes a circular cross-sectional shape, but could be any enclosed or open shape that is capable of conveying a liquid. The condensate conduit 250 shown includes a longitudinal slit 252 that extends substantially the length of the condensate conduit 250. The fingers 224 of the comb baffle portion 220 are sloped in the general direction of gravity backed toward the downstream face 140 of the core 122 transitioning into the planar portion 223, which then extends directly into longitudinal slit 252 of the condensate extractor 200. Shown in FIG. 7, the condensate conduit 250 may define apertures 254 periodically along the slit 252 to facilitate the extraction of condensate 26 from the planar segment 223 into the conduit. The conduit may also be sloped such that the condensate 26 drains toward a spout 256 at an edge of the core 122. A hem 260 may be provided at the end edge of the comb baffle portion 220 to maintain the conduit onto the comb baffle portion 220.

Figure 9:
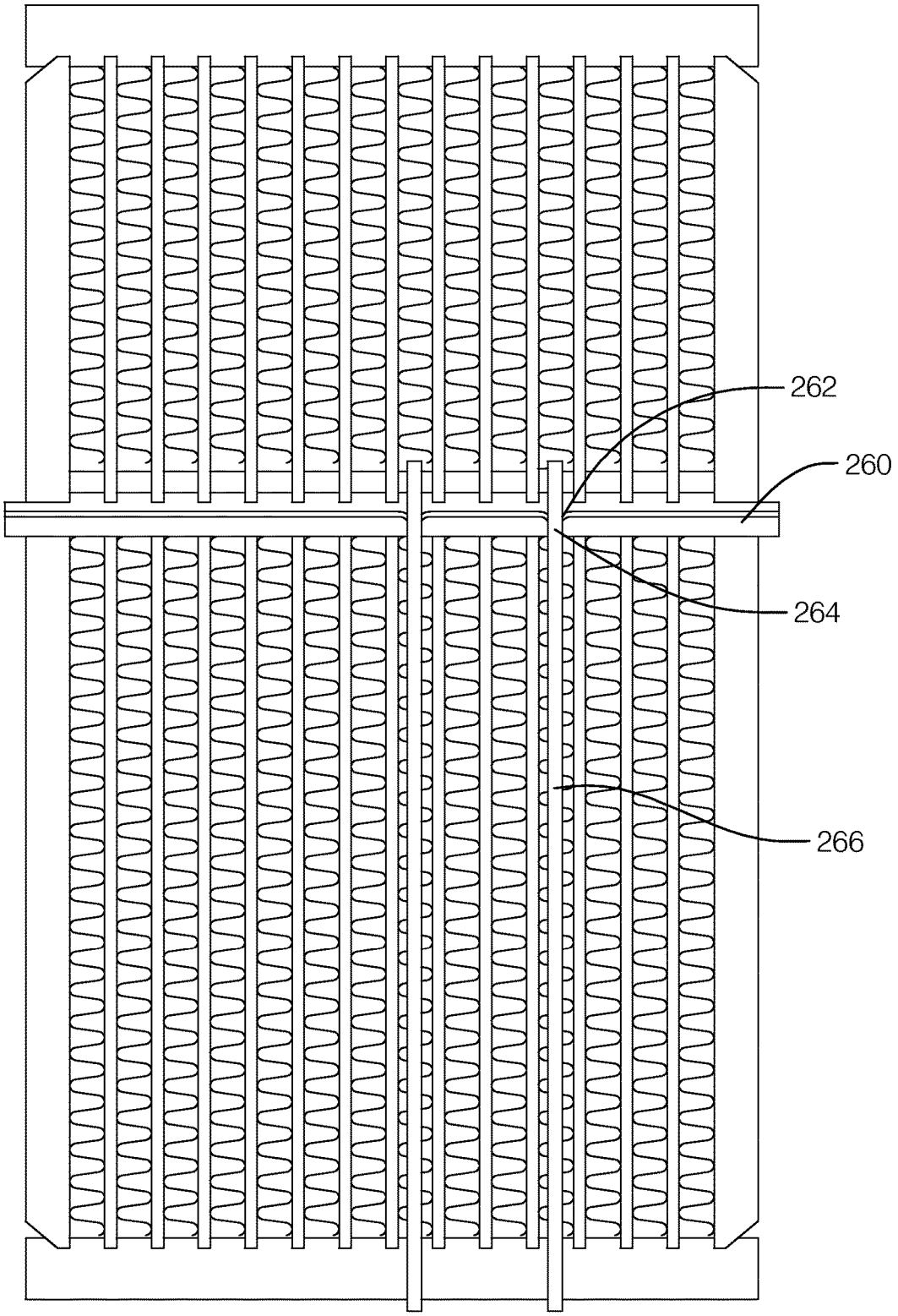
FIG. 9 shows the heat exchanger assembly of FIG. 3 having another alternative condensate collection portion of the condensate extractor of FIG. 3.

FIG. 9 shows a condensate extractor 200 having another alternative embodiment of the conveyance portion 210, which includes a hem 260 at the end edge of the comb baffle away from the core 122 with a few slight depressions 262. In these depressions, a small hole 264 is provided and a thin piece of plastic or metal wire 266 is run to the bottom of the core 122. The condensate 26 will then follow these thin lines to the bottom of the core 122 and away from the heat exchanger assembly 100. A twisted multiple strand wire appears to be better at moving the condensate 26 and not allow it to be launched off by airflow through the core 122.

The heat exchanger assembly 10 having a condensate extractor 200 disclosed herein provides a simple elegant solution to extract and convey condensate away from the heat exchanger core 122. The conveyance of condensate 26 away from the core 122 minimalizes the obstruction of airflow through the core 122, thereby improving heat transfer efficiency and eliminates condensate launching from the core 122 into the plenum downstream.

While a specific embodiment of the invention have been described and illustrated, it is to be understood that the embodiment is provided by way of example only and that the invention is not to be construed as being limited but only by proper scope of the following claims.

Having described the invention, it is claimed:

1. A heat exchanger assembly comprising:

a first manifold;

a second manifold spaced from the first manifold;

a plurality of refrigerant tubes, each refrigerant tube of the plurality of refrigerant tubes extending along a tube length from the first manifold to the second manifold and is in hydraulic communication with the first and second manifolds;

a plurality of corrugated fins inserted between the plurality of refrigerant tubes, thereby defining a core having a plurality of flow channels for airflow from an upstream face of the core to a downstream face of the core, the plurality of corrugated fins having one group of fins forming upper fins defining an upper core portion extending from the first manifold along an upper portion of the tube length and spaced from the second manifold, and another group of fins forming lower fins defining a lower core portion extending from the second manifold along a lower portion of the tube length and spaced from upper core portion and from the first manifold; and a condensate extractor having a comb baffle portion, wherein the comb baffle portion includes a plurality of fingers extending into the plurality of flow channels between the upper core portion and the lower core portion between the upper portion of the tube length and the lower portion of the tube length and configured to extract condensate from between the plurality of refrigerant tubes, wherein the comb baffle portion transitions into a condensate conveyance portion and wherein at least one of the fingers includes a distal end having an upturned segment engaging either of the downstream face and the upstream face of the core, and wherein the upturned segment of the fingers cooperate with the condensate conveyance portion to clip the condensate extractor onto the heat exchanger assembly.

2. The heat exchanger assembly of claim 1, wherein the condensate extracted by the fingers gravity flows from the comb baffle portion to the conveyance portion due to gravity.

3. The heat exchanger assembly of claim 2, wherein the condensate conveyance portion is positioned immediately adjacent to one of the downstream face and the upstream face of the core.

4. The heat exchanger assembly of claim 2, wherein the condensate conveyance portion includes a trough sloped at an angle sufficient for the condensate to flow to an end of the trough.

5. The heat exchanger assembly of claim 2, wherein the condensate conveyance portion includes:

an edge having a hem opposite that of the fingers of the comb baffle portion;

a condensate conduit having a longitudinal slit to accept the insertion of the hem edge into the condensate conduit; and a plurality of apertures along the longitudinal slit configured to accept gravity flow of condensate into the condensate conduit.

6. The heat exchanger assembly of claim 2, wherein the condensate conveyance portion includes:

an edge having a hem opposite that of the fingers of the comb baffle portion;

at least one depression on the hem defining a hole; and a strand of material extending from the hole in the direction of gravity toward the lower core portion.

7. The heat exchanger assembly of claim 2, wherein the refrigerant tubes include flat exterior surfaces;

wherein the plurality of fins includes trailing edges and the plurality of refrigerant tubes includes rear noses, wherein the rear noses extend beyond the trailing edges, thereby defining gap surfaces on the flat exterior surfaces of the plurality of refrigerant tubes between the trailing edges of the fins and the rear noses of the refrigerant tubes.

8. The heat exchanger assembly of claim 7, wherein the condensate conveyance portion is positioned immediately adjacent to the downstream face adjacent to the gap surfaces such that the fingers of the comb baffle portion intercept and redirect condensate flowing along the gap surfaces.

9. The heat exchanger assembly of claim 2, wherein the plurality of fins includes leading edges and the plurality of refrigerant tubes includes front noses, wherein the leading edges extend beyond the front nose, thereby defining an overhang of fins beyond the front nose.

10. The heat exchanger assembly of claim 9, wherein each of the plurality of fingers includes a distal end having an upturned segment engaged to one of the leading edges of the plurality of fins.

11. The heat exchanger assembly of claim 1, wherein the refrigerant tubes includes flat exterior surfaces; and wherein the plurality of fingers are configured to seal against the flat exterior surfaces of the plurality of the refrigerant tubes, such that the plurality of fingers intercept and redirect condensate away from the core.

12. A heat exchanger assembly comprising:

a first manifold;

a second manifold spaced from the first manifold;

a plurality of refrigerant tubes extending along a tube length between and in hydraulic communication with the first and second manifolds;

a plurality of corrugated fins inserted between the plurality of refrigerant tubes, thereby defining a core having a plurality of flow channels for airflow from a upstream face of the core to a downstream face of the core; and a condensate extractor having a comb baffle portion, wherein the comb baffle portion is spaced apart along the tube length from both the first manifold and the second manifold and includes fingers extending into the flow channels and configured to extract condensate from between the plurality of refrigerant tubes, wherein the plurality of fingers includes a plurality of distal ends having a distal end having an upturned segment engaged to leading edges of the plurality of fins, wherein the comb baffle portion transitions into a condensate conveyance portion, such that the condensate extracted by the fingers gravity flows from the comb baffle portion to the conveyance portion, wherein the refrigerant tubes include flat exterior surfaces;

wherein the plurality of fins includes trailing edges and the plurality of refrigerant tubes includes rear noses, and wherein the rear noses extend beyond the trailing edges, thereby defining gap surfaces on the flat exterior surfaces of the plurality of refrigerant tubes between the trailing edges of the fins and the rear noses of the refrigerant tubes.

13. The heat exchanger assembly of claim 12, wherein the condensate conveyance portion is positioned immediately adjacent to the downstream face adjacent to the gap surfaces such that the fingers of the comb baffle portion intercept and redirect condensate flowing along the gap surfaces.

14. The heat exchanger assembly of claim 13, wherein the plurality of refrigerant tubes includes front noses, wherein the leading edges extend beyond the front nose, thereby defining an overhang of fins beyond the front nose.

* * * * *